US009691246B2

(12) United States Patent
Ebner et al.

(10) Patent No.: US 9,691,246 B2
(45) Date of Patent: Jun. 27, 2017

(54) FLAME DETECTOR FOR MONITORING A REGION ADJACENT TO BODIES OF WATER AND TAKING INTO CONSIDERATION A DEGREE OF POLARIZATION PRESENT IN THE RECEIVED LIGHT FOR THE ACTIVATION OF A FIRE ALARM

(71) Applicant: Siemens Schweiz AG, Zurich (CH)

(72) Inventors: Harald Ebner, Baar (CH); Hilmar Konrad, Baar (CH)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 15/098,539

(22) Filed: Apr. 14, 2016

(65) Prior Publication Data

US 2016/0307423 A1 Oct. 20, 2016

(30) Foreign Application Priority Data

Apr. 14, 2015 (DE) ..... 10 2015 206 611

(51) Int. Cl.
*G08B 17/12* (2006.01)
*G08B 29/18* (2006.01)

(52) U.S. Cl.
CPC ..... *G08B 17/12* (2013.01); *G08B 29/185* (2013.01)

(58) Field of Classification Search
CPC ..... G08B 17/12; G08B 29/185
See application file for complete search history.

(56) References Cited

U.S. PATENT DOCUMENTS 4,775,853 A 10/1988 Perez Borruat ..... 340/521
5,576,697 A * 11/1996 Nagashima ..... G08B 29/183 250/574
2005/0042140 A1* 2/2005 Fiolka ..... G01J 1/48 422/91

(Continued)

FOREIGN PATENT DOCUMENTS

JP 05128381 A 5/1993 ..... G01N 21/53

OTHER PUBLICATIONS

German Office Action, Application No. 102015206611.8, 5 pages, Dec. 1, 2015.

*Primary Examiner* — Erin File
(74) *Attorney, Agent, or Firm* — Slayden Grubert Beard PLLC

(57) ABSTRACT

A flame detector, may be aligned to cover a region to be monitored near a body water. The flame detector has at least one radiation sensor and a downstream evaluation unit. The at least one radiation sensor is sensitive to light in the spectrum of open fire. The evaluation unit outputs a fire alarm in the event of fluctuations or flicker frequencies characteristic of open fire being detected. A linear polarizing filter positioned upstream of the radiation sensor(s) has a polarization plane rotated about a main receiving direction to largely suppress the horizontal component of the received light, based on the knowledge that light reflected from water surfaces is predominantly horizontally polarized. If characteristic flicker frequencies and a significant degree of polarization are simultaneously detected in the received light, the detector identifies sunlight reflected off bodies of water and modulated by the swell, and a false alarm output is inhibited.

13 Claims, 2 Drawing Sheets

(56) References Cited

U.S. PATENT DOCUMENTS

| | | | | |
|---|---|---|---|---|
| 2008/0246623 | A1* | 10/2008 | Nagashima | G01N 21/21 340/630 |
| 2010/0307600 | A1* | 12/2010 | Crucs | E03B 7/071 137/2 |
| 2011/0128541 | A1* | 6/2011 | Grueger | G01J 3/0256 356/326 |
| 2015/0204725 | A1* | 7/2015 | Huseynov | G01J 5/0018 250/338.3 |
| 2015/0204781 | A1* | 7/2015 | Wagner | G08B 17/107 356/342 |
| 2015/0276493 | A1* | 10/2015 | Tsuchiya | G01J 5/34 250/338.3 |

* cited by examiner

FLAME DETECTOR FOR MONITORING A REGION ADJACENT TO BODIES OF WATER AND TAKING INTO CONSIDERATION A DEGREE OF POLARIZATION PRESENT IN THE RECEIVED LIGHT FOR THE ACTIVATION OF A FIRE ALARM

CROSS-REFERENCE TO RELATED APPLICATIONS

This application claims priority to DE Application No. 10 2015 206 611.8 filed Apr. 14, 2015, the contents of which are hereby incorporated by reference in their entirety.

TECHNICAL FIELD

The invention relates to a flame detector that is aligned according to the intended purpose to cover a region to be monitored in the vicinity of bodies of water, i.e. adjacent to bodies of water, such as e.g. a lake, the sea, a river, a canal, reflecting water surfaces or pools of water on asphalt or concrete surfaces. The flame detector comprises at least one radiation sensor that is sensitive to light in the spectrum of open fire as well as an evaluation unit positioned downstream thereof. The radiation sensors are typically pyrosensors. Alternatively, they can be thermopiles. The evaluation unit is configured to output alarm information in the event of fluctuations or flicker frequencies characteristic of open fire being detected.

In the simplest case the alarm information is a fire alarm. It may also comprise several stages in the activation of an alarm, such as e.g. an early warning stage, a pre-alarm activation stage and an alarm activation stage. The alarm information can be output e.g. via a connected detector bus to a higher-ranking central fire alarm receiving system. The evaluation unit is preferably a microcontroller. Such a microcontroller then has the computational steps required for a mathematical evaluation. The microcontroller can also have a multichannel A/D converter for converting the sensor signal output by a radiation sensor into a corresponding digital value. Preferably, the microcontroller is configured to handle all of the control and evaluation functions of the flame detector up to and including the issuing of an alarm.

The invention also relates to a method for increasing the reliability of a fire alarm activation in the case of optical flame detection as well as to a suitable use.

BACKGROUND

U.S. Pat. No. 4,775,853 (abstract) discloses a device and installation provided for the instantaneous and simultaneous detection, inside and outside, of radiations emitted in the infrared, visible and ultraviolet spectra by simultaneous physical phenomena having a character of risk, such as intrusion, fire, explosion, leaks of dangerous fluids and electric leaks, disturbances and absence of movement of a regular periodic phenomenon, said radiations being emitted directly by the phenomena to be monitored at the time when the risk appears or being caused artificially by directing over an appropriate field of view, in which take place said phenomena, a source of radiation comprised in the infrared, visible and ultraviolet, and adapted to the nature of the phenomena involved, said field of view covered by the detection device (video camera) having appropriate horizontal and vertical dimensions comprising at least one spectral correction filter with known pass band chosen as a function of the nature of the radiation, a linear or circular polarization filter, a microprism array, and an image booster.

Flame detectors of the above-cited type have been known for a long time. They are provided for the detection of open fire or glowing embers with the characteristic modulated emissions thereof as well as for outputting an alarm within a few seconds. For special applications, an alarm activation within a fraction of a second is also possible. With regard to the signal processing, flame detectors of said type are fine-tuned to the characteristic flicker frequencies of open fire, that is to say of flames and glowing embers, in the infrared range and, where appropriate, in the visible and ultraviolet range.

The known flame detectors have at least one first radiation sensor which is sensitive to infrared radiation in the 4.0 to 4.8 ?m wavelength range. Infrared radiation of said type is typically produced during the combustion of carbon and hydrocarbons. They can also have a further radiation sensor which is sensitive to characteristic emissions of metal fires in the UV range.

For outdoor applications, known flame detectors usually also have a second radiation sensor which is sensitive e.g. to infrared radiation in the 5.1 to 6.0 ?m wavelength range. Typically, this infrared radiation is stray radiation, such as e.g. infrared radiation from hot bodies, sunlight or radiation not originating from combustion processes of carbon and hydrocarbons. On the basis of the two sensor signals, an evaluation is then possible to determine whether open fire is involved or not in this case.

The above-cited flame detectors are typically aligned to a fire-safety critical region requiring to be monitored. This region may contain e.g. an internal combustion engine, a fuel depot or a raw materials warehouse.

In the vicinity of bodies of water and in particular on ships, it cannot be ruled out that reflected sunlight will also impinge on such a flame detector. The areas in the vicinity of such bodies of water are in particular ships, offshore drilling platforms, petrochemical plants or inshore or shoreline refineries, such as e.g. container ports. Ships include e.g. container ships, ferries, frigates or cruise ships. Particularly at these locations, fire constitutes one of the greatest hazards of all.

A problem in this case is the sporadic triggering of false alarms when the sun is low in the sky. The triggering of an alarm typically initiates an automatic request for an unnecessary, expensive and disruptive deployment of large numbers of fire fighters.

This problem is caused by the modulation of the reflected sunlight by the swell of the body of water in the flicker frequency range of the flame detector, i.e. in the frequency range from 8 to 20 Hz. It is in fact known to place e.g. a PE film (PE standing for polyethylene) or a wire mesh as a prefilter in front of the flame detectors or radiation sensors in order primarily to reduce the intensity of the incident reflected sunlight. In spite of this, false alarms in the event of unfavorable swell cannot be avoided in this case.

Furthermore, flame detectors having a broadband photocell with a daylight filter, such as e.g. in the 0.7 to 11 ??m wavelength range, are known from the prior art. The signal resulting from said photocell serves principally for adjusting the sensitivity of the aforementioned radiation sensors as well as the operating thresholds for the alarm activation in order to avoid an override caused in particular by directly incident sunlight. This additional sensor is also unable to prevent a false alarm.

SUMMARY

One embodiment provides a flame detector that is aligned according to the intended purpose to cover a region to be monitored in the vicinity of bodies of water, wherein the flame detector has a main receiving direction, wherein the flame detector has at least one pyrosensor as well as a downstream evaluation unit, wherein the at least one pyrosensor is sensitive to light in the spectrum of open fire, and wherein the evaluation unit is configured to output alarm information, in particular a fire alarm, in the event of fluctuations or flicker frequencies characteristic of open fire being detected, wherein a linear polarizing filter is positioned upstream of at least one pyrosensor, and wherein the respective upstream linear polarizing filter has a polarization plane rotated about the main receiving direction in such a way that mainly the horizontal component of the received light is suppressed.

In one embodiment, a spectral filter is positioned upstream of the respective pyrosensor or wherein the respective pyrosensor is provided with a spectral filter of said type.

In one embodiment, the flame detector has a housing with a light-transmissive protective screen, wherein the respective pyrosensor is arranged optically behind the protective screen and wherein the respective polarizing filter is arranged in front of the protective screen, on the protective screen, between the protective screen and the respective pyrosensor, or on the respective pyrosensor.

Another embodiment provides a flame detector that is aligned according to the intended purpose to cover a region to be monitored in the vicinity of bodies of water, wherein the flame detector has at least one first and second radiation sensor as well as a downstream evaluation unit, wherein the first and second radiation sensors are sensitive to light in the spectrum of open fire, and wherein the evaluation unit is configured to output alarm information, in particular a fire alarm, in the event of fluctuations or flicker frequencies characteristic of open fire being detected, wherein a horizontal polarizing filter is positioned upstream of the first radiation sensor only, with the result that mainly the vertical component of the light reflected off bodies of water is suppressed, or wherein a vertical polarizing filter is positioned upstream of the second radiation sensor only, with the result that mainly the horizontal component of the light reflected off bodies of water is suppressed, or wherein a horizontal polarizing filter is positioned upstream of the first radiation sensor and a vertical polarizing filter is positioned upstream of the second radiation sensor, and wherein the downstream evaluation unit is configured to determine a degree of polarization of the vertical component of the received light from the respective two associated sensor signals and to take this into consideration in addition at the time of generating the alarm information.

In one embodiment, the flame detector has a housing with a light-transmissive protective screen, wherein the respective radiation sensor is arranged optically behind the protective screen and the respective polarizing filter is arranged in front of the protective screen, on the protective screen, between the protective screen and the respective radiation sensor, or on the respective radiation sensor.

In one embodiment, an electrically switchable polarizing filter is positioned upstream of at least one of the respective radiation sensors for the purpose of adjusting two polarization planes that are orthogonal to one another.

Another embodiment provides a flame detector that is aligned according to the intended purpose to cover a region to be monitored in the vicinity of bodies of water, wherein the flame detector has at least one radiation sensor as well as a downstream evaluation unit, wherein the at least one radiation sensor is sensitive to light in the spectrum of open fire, and wherein the evaluation unit is configured to output alarm information, in particular a fire alarm, in the event of fluctuations or flicker frequencies characteristic of open fire being detected, wherein the flame detector additionally has a device for determining the degree of polarization of received light from the region to be monitored, and wherein the downstream evaluation unit is configured to take into consideration the detected degree of polarization in addition at the time of generating the alarm information.

In one embodiment, the device is an optoelectronic component having two photodiodes which comprises two upstream linear polarizing filters that are orthogonal to one another.

In one embodiment, the optoelectronic component has internal measurement and evaluation electronics for determining the degree of polarization or a polarization direction and is configured to output the degree of polarization or the polarization direction as an electrical signal or as a data signal at an output.

In one embodiment, the evaluation unit is configured to output the alarm information if the degree of polarization is in a range from 0.4 to 0.6, in particular in a range from 0.45 to 0.55, or to output a warning message if the degree of polarization amounts to more than 0.6, in particular more than 0.8, or less than 0.4, in particular less than 0.2.

In one embodiment, the warning message is a pointer to potential open fire reflected off vertical or horizontal reflecting surfaces such as glass doors or floor coverings.

In one embodiment, a spectral filter is positioned upstream of the respective radiation sensor or wherein the respective radiation sensor is provided with a spectral filter of said type.

Another embodiment provides a method for increasing the reliability of a fire alarm activation in the case of optical flame detection of characteristic fluctuations or flicker frequencies of open fire, wherein the output of a fire alarm is suppressed if the received light exhibits a significant degree of polarization.

Another embodiment provides a use of an upstream linear polarizing filter for reducing the horizontal component of the sunlight reflected off water surfaces in the case of optical flame detection using at least one pyrosensor.

BRIEF DESCRIPTION OF THE DRAWINGS

Example embodiments and aspects of the invention are explained below with reference to the figures, in which.

DETAILED DESCRIPTION

Figure 1:
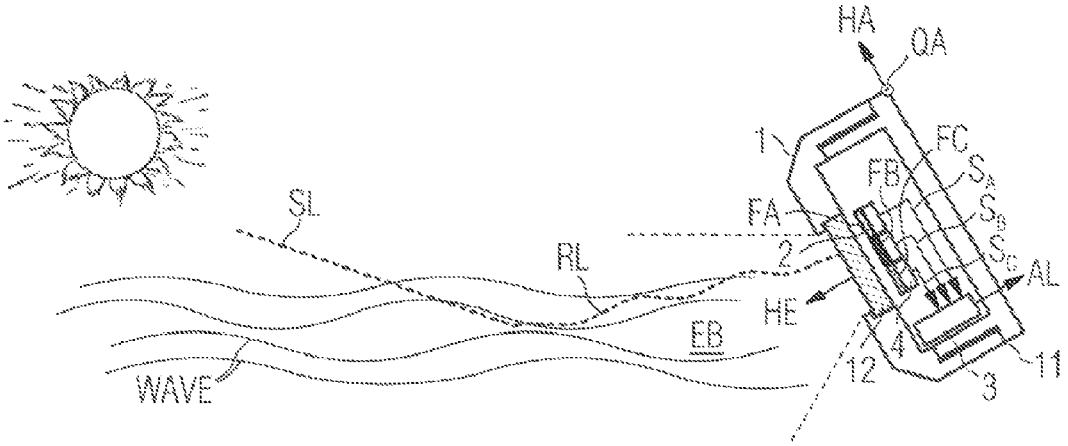
FIG. 1 shows a flame detector according to the prior art.

Embodiments of the invention disclose a flame detector that is more reliable with regard to the output of alarm information, a method, and a suitable use.

In some embodiments, a linear polarizing filter is positioned upstream of at least one radiation sensor, in particular at least one pyrosensor. The respective upstream linear polarizing filter has a polarization plane that is rotated about the main receiving direction in such a way that mainly the horizontal component of the received light is suppressed. By "mainly" is meant that at least 70%, in particular at least 85%, of the reflected light is suppressed.

Embodiments are based on the knowledge that the light reflected from water surfaces is predominantly horizontally polarized, whereas the part of the light entering the water is predominantly vertically polarized. If the received light is predominantly (horizontally) polarized, this is an indication of reflected light. In contrast, light from flames during combustion of carbon or hydrocarbons exhibits no significant polarization properties.

By virtue of the upstream vertical polarizing filter, at least some of the reflected and swell-modulated sunlight is effectively suppressed and so no longer reaches the radiation sensor for further signal evaluation. The probability of a false alarm is significantly reduced.

On the other hand, a vertically polarized fraction in the light from flames and glowing embers continues to reach the radiation sensor, with the result that flame detection is still possible.

The resulting sensor signal of a radiation sensor with upstream horizontal polarizing filter is referred to in the following as a horizontal sensor signal, which corresponds to the horizontally polarized signal fraction compared to the unfiltered signal fraction with regard to the polarization. Analogously, the vertically polarized signal fraction corresponds to the vertical sensor signal compared to the unfiltered signal fraction. According to the rules of vector algebra, the square of an unfiltered sensor signal is in this case equal to the sum of the squares from the horizontal sensor signal and the vertical sensor signal.

A (vertical) degree of polarization is now specified which describes the degree of vertical polarization of the received light, wherein the flame detector is aligned according to the intended purpose with respect to the upstream linear polarizing filter or filters. In the present example, the value range is normalized to a range from 0 to 1, where these values are yielded mathematically from the root of the sum of the squares of the vertical sensor signal and the horizontal sensor signal divided by the unfiltered sensor signal. A value 0 signifies that no vertical polarization or, as the case may be, only a horizontal polarization is present. This would be the purely theoretical case that the vertical component of the reflected sunlight penetrates in its entirety into the water and the horizontal component is reflected in its entirety. The value 1 means that only horizontal polarization is present. Unpolarized light, in contrast, would have a value of 0.5, since the vectorial subdivision of an assumed purely unpolarized received light would lead to vertical and horizontal sensor signals of equal absolute value and smaller by the factor 1/?2.

Instead of a vertical degree of polarization it is also possible to specify a horizontal degree of polarization, in which case the values are then inverted in the appropriate manner. Alternatively, other mathematical evaluation rules are of course possible. What is essential in this case is that the evaluation rules are suitable for describing significant differences with regard to the polarization properties of the received light.

According to a further embodiment, the flame detector has at least one first and second radiation sensor as well as a downstream evaluation unit. The first and second radiation sensors are sensitive to light in the spectrum of open fire. The evaluation unit is configured to output alarm information, in particular a fire alarm, in the event of fluctuations or flicker frequencies characteristic of open fire being detected.

The two radiation sensors are in particular of the same type. Both radiation sensors are preferably pyrosensors and are sensitive in the same wavelength range.

According to one embodiment, a horizontal polarizing filter is positioned upstream of the first radiation sensor only, with the result that mainly the vertical component of the light reflected off bodies of water is suppressed. No polarizing filter is positioned upstream of the second radiation sensor. The downstream evaluation unit is configured to calculate the degree of polarization mathematically from the horizontal sensor signal of the first radiation sensor and from the unfiltered sensor signal of the second radiation sensor and to take this into consideration in addition at the time of generating the alarm information.

According to another embodiment, a vertical polarizing filter is positioned upstream of the second radiation sensor only, with the result that mainly the horizontal component of the light reflected off bodies of water is suppressed. No polarizing filter is positioned upstream of the first radiation sensor. The downstream evaluation unit is configured to calculate the degree of polarization mathematically from the unfiltered sensor signal of the first radiation sensor and the vertical sensor signal of the second radiation sensor and to take this into consideration in addition at the time of generating the alarm information.

According to another embodiment, a horizontal polarizing filter is positioned upstream of the first radiation sensor and a vertical polarizing filter is positioned upstream of the second radiation sensor. The downstream evaluation unit is configured to calculate the degree of polarization mathematically from the horizontal sensor signal of the first radiation sensor and the vertical sensor signal of the second radiation sensor and to take this into consideration in addition at the time of generating the alarm information.

On account of the nonplanar wave shapes as well as due to other natural polarization mechanisms in the atmosphere, the reflected sunlight is not completely horizontally polarized. However, the light reflected off bodies of water is predominantly horizontally polarized. The evaluation unit is therefore configured to output the alarm information only when the determined degree of polarization lies in a range from 0.4 to 0.6, in particular in a range from 0.45 to 0.55. This is subject to the precondition that the evaluation unit has already detected or has just detected fluctuations or flicker frequencies that are characteristic of open fire. In other words, the alarm information, in particular a fire alarm, is output only when the received light is more or less unpolarized.

The evaluation unit can be additionally configured to output a warning message if the degree of polarization amounts to more than 0.6, in particular more than 0.8, or less than 0.4, in particular less than 0.2. In this case the received light is predominantly strongly polarized. The warning message is therefore a pointer to potential open fire which is reflected off vertical or horizontal surfaces, such as glass doors or floor coverings.

Instead of a single warning message it is also possible for two warning messages to be output by the evaluation unit, the first warning message being a pointer to potential open fire reflected off vertical surfaces such as glass doors if a degree of polarization of more than 0.6, in particular more than 0.8, is determined. The evaluation unit can output the second warning message if a degree of polarization of less than 0.4, in particular less than 0.2, is determined. This second warning message is a pointer to potential open fire reflected off horizontal surfaces such as floor coverings. This is in turn subject to the precondition that the evaluation unit has already detected or has just detected fluctuations or flicker frequencies that are characteristic of open fire.

According to a further embodiment, the flame detector has at least one radiation sensor as well as a downstream evaluation unit. The at least one radiation sensor is sensitive to light in the spectrum of open fire. The evaluation unit is configured to output alarm information, in particular a fire alarm, in the event of fluctuations or flicker frequencies characteristic of open fire being detected. In this case the flame detector additionally has an (optical) device for determining the degree of polarization of received light from the region that is to be monitored. The downstream evaluation unit is configured to take the detected degree of polarization into consideration in addition at the time of generating the alarm information.

The device for determining the degree of polarization can be a separate optoelectronic component. It can have e.g. two photodiodes with two upstream linear polarizing filters that are orthogonal to one another. Internal measurement and evaluation electronics can then determine the degree of polarization or a polarization direction and output the same as an electrical signal or as a data signal at an output.

According to a further embodiment, a spectral filter is positioned upstream of the respective radiation sensor or the latter is provided with a spectral filter of said type. As described in the introduction, this enables the respective radiation sensor to be spectrally tuned to light in the infrared range and, where appropriate, in the visible and ultraviolet range emanating from flames or nuisance sources.

According to another embodiment, the flame detector has a housing with a light-transmissive protective screen. The protective screen is preferably fabricated from sapphire, fused quartz glass, germanide glass, calcium fluoride or some other IR- and, where appropriate, UV-transparent material.

According to one embodiment, the respective radiation sensor is arranged optically behind the protective screen, in particular in the interior of the flame detector housing. The respective polarizing filter can be arranged in front of the protective screen, i.e. outside of the flame detector housing and spaced at a distance from the protective screen, on the protective screen, i.e. either outside or inside the housing, between protective screen and respective radiation sensor, or on the radiation sensor. Preferably, the polarizing filter is arranged in the interior of the housing.

According to a further embodiment, an electrically switchable polarizing filter is positioned upstream of at least one of the respective radiation sensors for the purpose of adjusting two polarization planes that are orthogonal to one another. As a result, only one radiation sensor is required for determining the degree of polarization. In particular, the evaluation unit is then configured to switch the electrically switchable polarizing filter cyclically between the two polarization planes, such that it acts as a linear vertical polarizing filter in a first time period and as a linear horizontal polarizing filter in a second time period. The electrical sensor signals captured in the respective two time periods are preferably digitized, such as e.g. using an A/D converter. The switchover frequency is preferably in a range from 50 Hz to 1000 Hz. Using temporal association it is then possible to determine mathematically and/or by signaling techniques from the respective two captured horizontal and vertical sensor signals a summation signal which substantially corresponds to a sensor signal without upstream polarizing filter, i.e. to an unfiltered sensor signal. This can be determined mathematically from the square root of the sum of the squares of the respective horizontal and vertical sensor signals.

The flame detector can advantageously be used on a ship, on an offshore drilling platform, in an inshore or shoreline petrochemical plant, in an inshore or shoreline refinery, or in a harbor, since these are precisely the locations where one may expect to encounter sunlight that is reflected off bodies of water and is modulated by the swell in the flicker frequency range, such as e.g. in light swell conditions.

Other embodiments provide a method for increasing the reliability of a fire alarm activation in the case of optical flame detection of fluctuations or flicker frequencies characteristic of open fire, wherein the output of a fire alarm is suppressed if the received light exhibits a significant (vertical) degree of polarization. As an alternative to the suppression of the fire alarm activation, a warning message can be output.

Other embodiments provide an inventive use of an upstream linear (vertical) polarizing filter for the purpose of reducing the sunlight reflected off water surfaces, e.g., for reducing the horizontal component of the sunlight, in the case of optical flame detection using at least one radiation sensor, e.g., at least one pyrosensor.

FIG. 1 shows a flame detector 1 according to the prior art. Reference numeral 11 designates a housing which is embodied in two parts and in which a protective screen 12 that is transparent to IR light and, where appropriate, to UV light is accommodated. Two radiation sensors 2 and a photocell 4 are arranged behind the protective screen 12 and in the interior of the housing. They are aligned for the purpose of monitoring a fire-critical region within an optical field of view or detection EB. A main receiving direction of the flame detector 1 is designated herein by HE. This is orthogonal both to the typically planar protective screen 12 and to the light-sensitive sensor surface (not shown in further detail in the figure) of the two radiation sensors 2 as well as to that of the photocell 4. The main receiving direction HE is orthogonal both to a transverse axis QA and to a normal axis HA of the flame detector 1.

A spectral filter FA, FB, each of which has a different wavelength range, is positioned upstream of each of the two radiation sensors 2. A daylight filter FC is positioned upstream of the photocell 4. It essentially registers the overall intensity of the incident light. SA, SB, SC denote the associated spectral sensor signals which are captured by an evaluation unit 3 and evaluated with regard to detection of a flame, as described in the introduction. The evaluation unit 3 is preferably a microcontroller having an already integrated multichannel A/D converter. In the event of a fire incident being detected, said evaluation unit 3 then outputs alarm information AL, such as e.g. to a connected detector line.

As FIG. 1 also shows, when a flame detector 1 is installed adjacent to bodies of water, it occasionally happens that when the sun is low in the sky the sunlight SL emitted by it is reflected off the body of water and then enters the optical field of detection EB of the flame detector 1 as reflected sunlight RL. If there are water waves WAVE, such as e.g. swell-generated waves, on the body of water due to the action of wind or to the wave effect, the sunlight SL is modulated by the swell. If the modulation frequency is still within the range of the typical flicker frequency of open fire, i.e. in a range from 8 to 20 Hz, then this event is mistakenly detected as open fire and an alarm is triggered.

Figure 2:
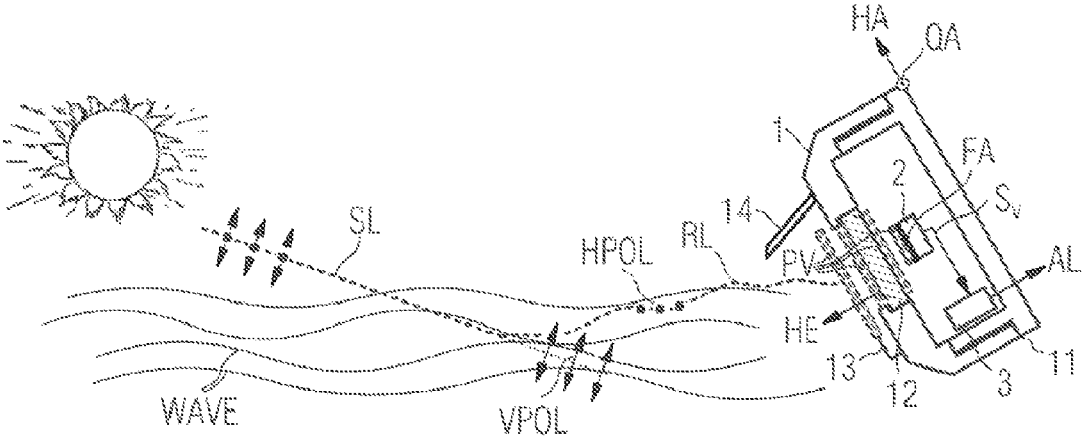
Prior art FIG 2
FIG. 2 shows an example of an example inventive flame detector according to a first embodiment.

FIG. 2 shows an example of an inventive flame detector 1 according to one example embodiment. In this case the flame detector 1 has only one radiation sensor 2, upstream of which a linear polarizing filter PV is positioned. Referring to the arrangement shown, the depicted polarizing filter PV is, according to its orientation, a vertical polarizing filter. SV denotes the associated "vertical" sensor signal, which is captured by the evaluation unit 3 and evaluated. As a result of the horizontal component of the received light being gated out, the sensor signal SV now only comprises the vertical component.

As FIG. 2 also shows, the vertical component VPOL of the sunlight SL incident on the body of water penetrates into the body of water. This component is not reflected. In contrast, only the horizontal component HPOL of the sunlight SL is reflected. This component, modulated by the swell and yet critical with regard to the flicker frequency, is nonetheless at least severely reduced or, as the case may be, suppressed by the vertical polarizing filter PV. In other words, the swell-modulated fraction is filtered out and consequently no longer reaches the downstream signal processing function. The output of a bogus fire alarm AL is prevented as a result.

In the case shown by a solid line, the polarizing filter PV is arranged, such as e.g. adhesively fixed, directly on the radiation sensor 2. Alternatively, as indicated by the dashed line, the polarizing filter PV can also be mounted on the protective screen 12 or e.g. installed in front of the protective screen 12 by a retaining fixture 13. In addition, the radiation sensor 2 shown also has a spectral filter FA which allows only infrared radiation typical of open fire in the 4.0 to 4.8 ?m wavelength range to pass. Reference numeral 14 designates a visor which is provided for shading the flame detector 1.

Figure 3:
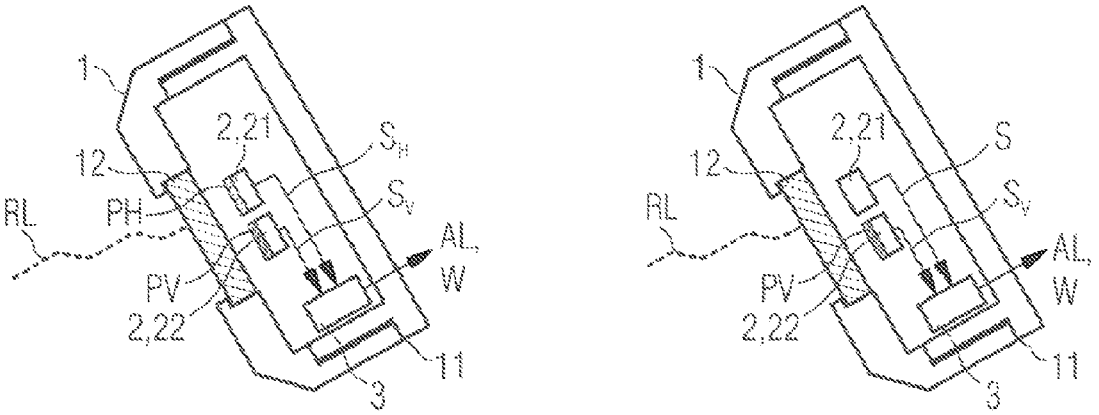
FIG. 3 shows examples of an example inventive flame detector according to second and third example embodiments.

FIG. 3 shows examples of an inventive flame detector 2 according to other example embodiments. For clarity of illustration reasons, spectral filters have been omitted from the drawing. However, the two radiation sensors 21, 22 typically have an identical spectral filter.

In the left-hand part of FIG. 3, a horizontal polarizing filter PH is positioned upstream of the first radiation sensor 21 and a vertical polarizing filter PV is positioned upstream of the second radiation sensor 22. The associated horizontal sensor signal is designated by SH, and the associated vertical sensor signal by SV. The two signals SH, SV are captured by the evaluation unit 3 and evaluated. The evaluation unit 3 is configured to determine a degree of polarization P of the received light RL from the two associated sensor signals SH, SV and to take this into consideration in addition at the time of generating the alarm information AL.

The associated block diagram of this second embodiment variant is explained with reference to the example shown in FIG. 4.

Figure 4:
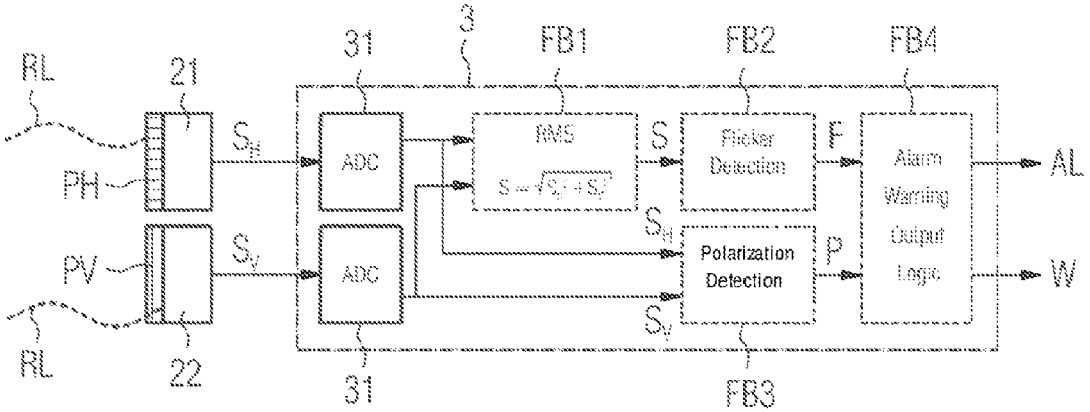
FIG. 4 shows a block diagram of the example flame detector 1 according to the second embodiment of FIG. 3.

In the left-hand part of FIG. 4, the reflected light RL is filtered by the horizontal polarizing filter and the vertical polarizing filter PH, PV, respectively, and then supplied to the respective radiation sensor 21, 22. The downstream evaluation unit 3 has already integrated A/D converters 31 which convert the two captured horizontal and vertical sensor signals SH, SV into a respective digital value. In a subsequent first function block FB1 implemented by software, a summation signal S is mathematically formed as a vector sum from the two vertical sensor signals SH, SV, which summation signal S roughly corresponds to a sensor signal that one of the two radiation sensors 21, 22 would supply without upstream polarizing filter PH, PH. A downstream function block FB2 mathematically determines on the basis of digital filters whether fluctuations or flicker frequencies that are characteristic of open fire are present in the reconstructed sensor signal S. In this case a flicker signal F is output to a downstream evaluation function block FB4. In parallel therewith, a third function block FB3 determines the degree of polarization P and outputs the same to the fourth function block FB4. If characteristic fluctuations or flicker frequencies are present, the latter outputs either a fire alarm AL or a warning message W, depending on the determined degree of polarization P.

In the right-hand part of FIG. 3, a further example embodiment of the flame detector 1 is shown. Compared to the previous embodiment variant, there is now no polarizing filter positioned upstream of the first radiation sensor 21. Accordingly, said radiation sensor outputs the unfiltered sensor signal S. In this case the evaluation unit 3 is configured to convert the captured vertical sensor signal SV and the captured unfiltered sensor signal S initially into a respective digital value. In a downstream function block, the associated horizontal sensor signal SH can then be determined by vector algebra from the two sensor signals S, SV. The further signal processing and evaluation follows accordingly as shown in FIG. 4.

LIST OF REFERENCE SIGNS

1 Flame detector
2, 21, 22 Radiation sensor, pyrosensor, IR sensor, UV sensor
3 Evaluation unit, processing unit, microcontroller, processor
4 Photocell, light sensor with daylight filter
11 Detector housing, housing
12 Protective screen
13 Retaining fixture
14 Shade, sun visor
31 A/D converter
AL Alarm information, alarm message, fire alarm
EB Receiving field, field of view/detection
F Flicker signal
FB1-FB4 Function blocks
FA, FB, FC Spectral filters
HA Normal axis
HE Main receiving direction
HPOL Horizontal component
P Degree of polarization
PH Linear polarizing filter, horizontal polarizing filter
POL Switchable polarizing filter
PV Linear polarizing filter, vertical polarizing filter
QA Transverse axis
RL Reflected sunlight, received light
SA, SB, SC Spectral sensor signals
S Unfiltered sensor signal, summation signal
SH Horizontal sensor signal, horizontally polarized sensor signal
SL Sunlight
SV Vertical sensor signal, vertically polarized sensor signal
VPOL Vertical component
WAVE Water waves
W Warning message

What is claimed is:

1. A flame detector aligned to cover a region to be monitored near a body of water, the flame detector having a main receiving direction for receiving light, and comprising:

at least one pyrosensor sensitive to light in the spectrum of open fire, a housing with a light-transmissive protective screen, wherein the at least one pyrosensor is arranged optically behind the protective screen, a downstream evaluation unit configured to output fire alarm information in response to detecting fluctuations or flicker frequencies characteristic of open fire, and a linear polarizing filter positioned upstream of the at least one pyrosensor and having a polarization plane rotated about the main receiving direction of the flame detector to suppress a horizontal component of light received at the flame detector.

2. The flame detector of claim 1, comprising a spectral filter, wherein the spectral filter is positioned upstream of the respective pyrosensor or included as a component of a respective pyrosensor.

3. The flame detector of claim 1, wherein the polarizing filter is arranged in front of the protective screen, on the protective screen, between the protective screen and the respective pyrosensor, or on the respective pyrosensor.

4. A flame detector aligned to cover a region to be monitored near a body of water, the flame detector comprising:

a first radiation sensor and a second radiation sensor, each sensitive to light in the spectrum of open fire, a downstream evaluation unit configured to output fire alarm information in response to detecting fluctuations or flicker frequencies characteristic of open fire, at least one filter arrangement chosen from the group consisting of:

a horizontal polarizing filter positioned upstream of the first radiation sensor only, to thereby suppress mainly a vertical component of light reflected off the body of water, or a vertical polarizing filter positioned upstream of the second radiation sensor only, to thereby suppress mainly a horizontal component of light reflected off the body of water, or a horizontal polarizing filter positioned upstream of the first radiation sensor and a vertical polarizing filter positioned upstream of the second radiation sensor, a housing with a light-transmissive protective screen, wherein a respective radiation sensor is arranged optically behind the protective screen, and wherein the downstream evaluation unit is configured to:

determine a degree of polarization of the vertical component of received light based on sensor signals from both the first and second radiation sensors, and to generate the fire alarm information based at least on the determined degree of polarization of the vertical component of the received light.

5. The flame detector of claim 4, wherein a respective polarizing filter is arranged in front of the protective screen, on the protective screen, between the protective screen and the respective radiation sensor, or on the respective radiation sensor.

6. The flame detector of claim 4, comprising an electrically switchable polarizing filter positioned upstream of at least one of the radiation sensors and configured to adjust two polarization planes orthogonal to one another.

7. The flame detector of claim 4, wherein the downstream evaluation unit is configured to:

output the fire alarm information if the degree of polarization is in a range from 0.4 to 0.6, or output a warning message if the degree of polarization is greater than 0.6 or less than 0.4.

8. The flame detector of claim 7, wherein the warning message comprises an indicator of potential open fire, wherein the warning message further indicates whether the potential open fire is reflected off of vertical or horizontal reflecting surfaces.

9. The flame detector of claim 4, comprising a spectral filter, wherein the spectral filter is positioned upstream of a respective radiation sensor or wherein the spectral filter is included in a respective radiation sensor.

10. The flame detector of claim 4, wherein the downstream evaluation unit is configured to output the fire alarm information if the degree of polarization is in a range from 0.45 to 0.55.

11. The flame detector of claim 4, wherein the downstream evaluation unit is configured to output a warning message if the degree of polarization is greater than 0.8 or less than 0.2.

12. A flame detector aligned to cover a region to be monitored near a body of water, the flame detector comprising:

at least one radiation sensor sensitive to light in the spectrum of open fire, a downstream evaluation unit configured to output fire alarm information in response to detecting fluctuations or flicker frequencies characteristic of open fire, an optoelectronic component including:

two photodiodes comprising two upstream linear polarizing filters orthogonal to one another; and internal measurement and evaluation electronics configured to determine a degree of polarization of received light from the region to be monitored or a polarization direction and to provide the degree of polarization or the polarization direction to the downstream evaluation unit, and wherein the downstream evaluation unit is configured to generate the alarm information based at least on the determined degree of polarization of the received light.

13. A method for controlling a fire alarm activation in the case of optical flame detection of characteristic fluctuations or flicker frequencies of open fire, the method comprising:

receiving sensor signals from at least one pyrosensor sensitive to light in the spectrum of open fire;

the at least one pyrosensor disposed optically behind a light-transmissive protective screen and a linear polarizing filter having a polarization plane rotated about a main receiving direction to suppress a horizontal component of light received at the at least one pyrosensor;

detecting fluctuations or flicker frequencies characteristic of open fire at a downstream evaluation unit, based on the sensor signals;

determining a degree of polarization based on the sensor signals;

determining whether to generate a fire alarm based on the determined degree of polarization.

* * * * *